US011209003B2

(12) United States Patent
Lee et al.

(10) Patent No.: US 11,209,003 B2
(45) Date of Patent: Dec. 28, 2021

(54) COMPRESSOR WITH A MUFFLER

(71) Applicant: LG Electronics Inc., Seoul (KR)

(72) Inventors: Howon Lee, Seoul (KR); Taekyoung Kim, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 214 days.

(21) Appl. No.: 16/510,464

(22) Filed: Jul. 12, 2019

(65) Prior Publication Data

US 2020/0032803 A1 Jan. 30, 2020

(30) Foreign Application Priority Data

Jul. 13, 2018 (KR) ..... 10-2018-0081774

(51) Int. Cl.
*F04C 29/12* (2006.01)
*F04C 18/02* (2006.01)
*F04C 29/06* (2006.01)

(52) U.S. Cl.
CPC ..... *F04C 29/12* (2013.01); *F04C 18/0269* (2013.01); *F04C 29/065* (2013.01); *F04C 29/068* (2013.01)

(58) Field of Classification Search
CPC ..... F04C 29/12; F04C 29/066; F04C 29/065; F04C 29/068; F04C 18/0269; F04C 18/0246; F04C 18/0261; F04C 18/0215; F04C 23/008
See application file for complete search history.

(56) References Cited

U.S. PATENT DOCUMENTS

| | | | | |
|---|---|---|---|---|
| 7,802,972 | B2 | 9/2010 | Shimizu et al. | |
| 9,726,177 | B2 | 8/2017 | Choi et al. | |
| 9,951,773 | B2 | 4/2018 | Choi et al. | |
| 2004/0005236 | A1* | 1/2004 | Lee | F04C 29/0085 418/219 |
| 2011/0138848 | A1* | 6/2011 | Byun | F04C 28/065 62/498 |
| 2016/0047378 | A1* | 2/2016 | Choi | F04C 18/0292 418/55.1 |
| 2017/0306953 | A1 | 10/2017 | Choi et al. | |
| 2017/0306964 | A1 | 10/2017 | Kim et al. | |
| 2018/0066657 | A1* | 3/2018 | Perevozchikov | F01C 21/007 |

FOREIGN PATENT DOCUMENTS

| | | |
|---|---|---|
| CN | 101160468 | 4/2008 |
| CN | 105370571 | 3/2016 |
| CN | 105370572 | 3/2016 |
| CN | 105370573 | 3/2016 |
| CN | 107313930 | 11/2017 |
| KR | 1020160020190 | 2/2016 |

(Continued)

OTHER PUBLICATIONS

Extended European Search Report in European Application No. 19186060.0, dated Dec. 12, 2019, 8 pages.

(Continued)

*Primary Examiner* — Deming Wan
(74) *Attorney, Agent, or Firm* — Fish & Richardson P.C.

(57) ABSTRACT

Disclosed herein is a scroll compressor in which the discharge hole is formed to have an axial length less than an axial length of the fixed shaft accommodation portion, thereby increasing efficiency.

19 Claims, 7 Drawing Sheets

(56) References Cited

FOREIGN PATENT DOCUMENTS

| | | |
|---|---|---|
| KR | 1020170122015 | 11/2017 |
| WO | WO2011155176 | 12/2011 |
| WO | WO2012005007 | 1/2012 |

OTHER PUBLICATIONS

Korean Notice of Allowance in Korean Application No. 10-2018-0081774, dated Nov. 25, 2019, 1 page (with English translation) .
CN Office Action in Chinese Appln. No. 201910635709.1, dated Feb. 1, 2021, 13 pages (with English translation).

* cited by examiner

COMPRESSOR WITH A MUFFLER

CROSS-REFERENCE TO RELATED APPLICATIONS

This application claims the benefit of Korean Patent Application No. 10-2018-0081774, filed on Jul. 13, 2018, which is hereby incorporated by reference as if fully set forth herein.

FIELD

The present invention relates to a compressor. More particularly, the present invention relates to a scroll compressor capable of reducing the injection volume and the discharge loss by changing the shape of a head plate of a fixed scroll.

BACKGROUND

Generally, a compressor is a device applied to a refrigeration cycle (hereinafter referred to simply as a refrigeration cycle) such as a refrigerator or an air conditioner. The compressor compresses the refrigerant to provide energy necessary for heat exchange in the refrigeration cycle.

Compressors can be divided into reciprocating compressors, rotary compressors, and scroll compressors according to how the refrigerant is compressed. The scroll compressor is a compressor in which an orbiting scroll is pivotably engaged with a fixed scroll fixed in the inner space of a hermetically sealed container to form a compression chamber between a fixed wrap of the fixed scroll and an orbiting wrap of the orbiting scroll.

The scroll compressor is widely employed in an air conditioner or the like to compress a refrigerant because it can obtain a relatively high compression ratio as compared with other types of compressors and can obtain a stable torque as the intake, compression and discharge operations of the refrigerant are smoothly connected to each other.

The conventional scroll compressor includes a case defining an outer appearance and having a discharge portion through which a refrigerant is discharged, a compression unit fixed to the case and configured to compress the refrigerant, and a drive unit is fixed to the case and configured to drive the compression unit.

The compression unit includes a fixed scroll fixed to the case and having a fixed wrap, and an orbiting scroll including an orbiting wrap engaging with the fixed wrap and driven by a drive unit.

In the conventional scroll compressor, the compression unit is disposed between the discharge portion and the drive unit, and thus the discharge portion is located on the side or the lower portion. Accordingly, the refrigerant compressed by the compression unit can be discharged directly to the discharge portion.

Since the orbiting scroll of the compression unit eccentrically rotate around the fixed scroll and the rotary shaft, it generates strong vibration. Therefore, for the conventional scroll compressor, a balancer needs to be arranged on a side of the drive unit facing away from the discharge portion.

However, since the balancer is coupled to the rotary shaft extending from the drive unit, the rotary shaft is bent by the vibration of the balancer, or flow resistance is generated due to the balancer rotating in contact with oil or the like.

In order to address this issue, a scroll compressor (a so-called lower scroll compressor) in which the drive unit is disposed between the discharge portion and the compression unit has recently been introduced.

This scroll compressor has the drive unit arranged between the discharge portion and the compression unit, and accordingly the balancer can be disposed between the drive unit and the compression unit.

Thus, the balancer of the scroll compressor is not arranged outside the drive unit or the compression unit, and therefore the scroll compressor can prevent the rotary shaft from being bent or the balancer from being submerged in the fluid while rotating.

However, since the fixed scroll is arranged at the outermost side, the refrigerant is discharged to a side opposite to the discharge portion. Therefore, for the scroll compressor, a muffler for guiding the discharged refrigerant to the discharge portion needs to be additionally disposed at the outermost side of the fixed scroll.

Such a scroll compressor causes discharge loss since the refrigerant comes into contact with the fixed scroll while passing through the fixed scroll.

Further, since the fixed scroll has an area which is irrelevant to compression of the refrigerant, unnecessary energy is required, which results in a dead volume loss.

Further, when the fixed scroll is provided with a thick shaft accommodation portion in order to be firmly coupled to the rotary shaft connected to the drive unit, the discharge loss and the dead volume loss are correspondingly increased.

Further, as the refrigerant discharged from the fixed scroll immediately collides with the muffler, the flow loss is increased.

SUMMARY

Accordingly, the present invention is directed to a compressor that substantially obviates one or more problems due to limitations and disadvantages of the related art.

An object of the present invention is to provide a compressor capable of minimizing a length of flow of a refrigerant inside a fixed scroll by reducing the thickness of a head plate of the fixed scroll.

Another object of the present invention is to provide a compressor capable of eliminating a volume irrelevant to compression of the refrigerant by reducing the thickness of the head plate of the fixed scroll.

Another object of the present invention is to provide a compressor that extends a length of spacing between a discharge hole of the fixed scroll through which the refrigerant is discharged and a muffler.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a compressor includes a case provided on one side with a discharge portion for discharging a refrigerant, a drive unit coupled to an inner circumferential surface of the case, a rotary shaft extending from the drive unit in a direction away from the discharge portion and configured to rotate, an orbiting scroll coupled to the rotary shaft and configured to make an orbiting movement when the rotary shaft rotates, a fixed scroll coupled to the case and engaged with the orbiting scroll to receive, compress and discharge the refrigerant, and a muffler coupled to a side of the fixed scroll facing away from the discharge portion to form a space for guiding the refrigerant to the discharge portion, The fixed scroll may include a fixed head plate coupled to the orbiting scroll, a fixed shaft accommodation portion provided to the fixed head plate to accommodate a bearing coupled to the rotary shaft, a discharge hole formed through the fixed head plate to discharge the refrigerant in a direction away from the discharge portion, and a bypass hole formed through the fixed head plate to guide the refrigerant to the discharge portion.

An axial length of the discharge hole may be less than an axial length of the fixed shaft accommodation portion.

The orbiting scroll may include an orbiting wrap provided on one surface thereof, wherein the fixed plate may include a fixed wrap coupled with the orbiting wrap.

A length from the fixed wrap to a distal end of the discharge hole may be less than a length from the fixed wrap to a distal end of the fixed shaft accommodation portion.

The fixed shaft accommodation portion may protrude from the fixed head plate toward the muffler, and the discharge hole may be formed in one surface of the fixed head plate.

A thickness of the fixed plate may be less than a thickness of the fixed shaft accommodation portion.

The fixed head plate may include a depressed portion formed by curving a portion provided with the discharge hole.

A diameter of the depressed portion may be greater than a diameter of the discharge hole.

A slope of the depressed portion may become steeper as a distance from the discharge hole increases.

A slope of the depressed portion may become gentler as a distance from the discharge hole increases.

A distance between the bypass hole and the muffler may be longer than a distance between a distal end of the fixed shaft accommodation portion and the muffler.

The fixed head plate may include a concave portion formed to have a thickness decreasing from the fixed shaft accommodation portion to the bypass hole.

The fixed head plate may further include a guide protruding from an outer side the bypass hole to guide the refrigerant to the bypass hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
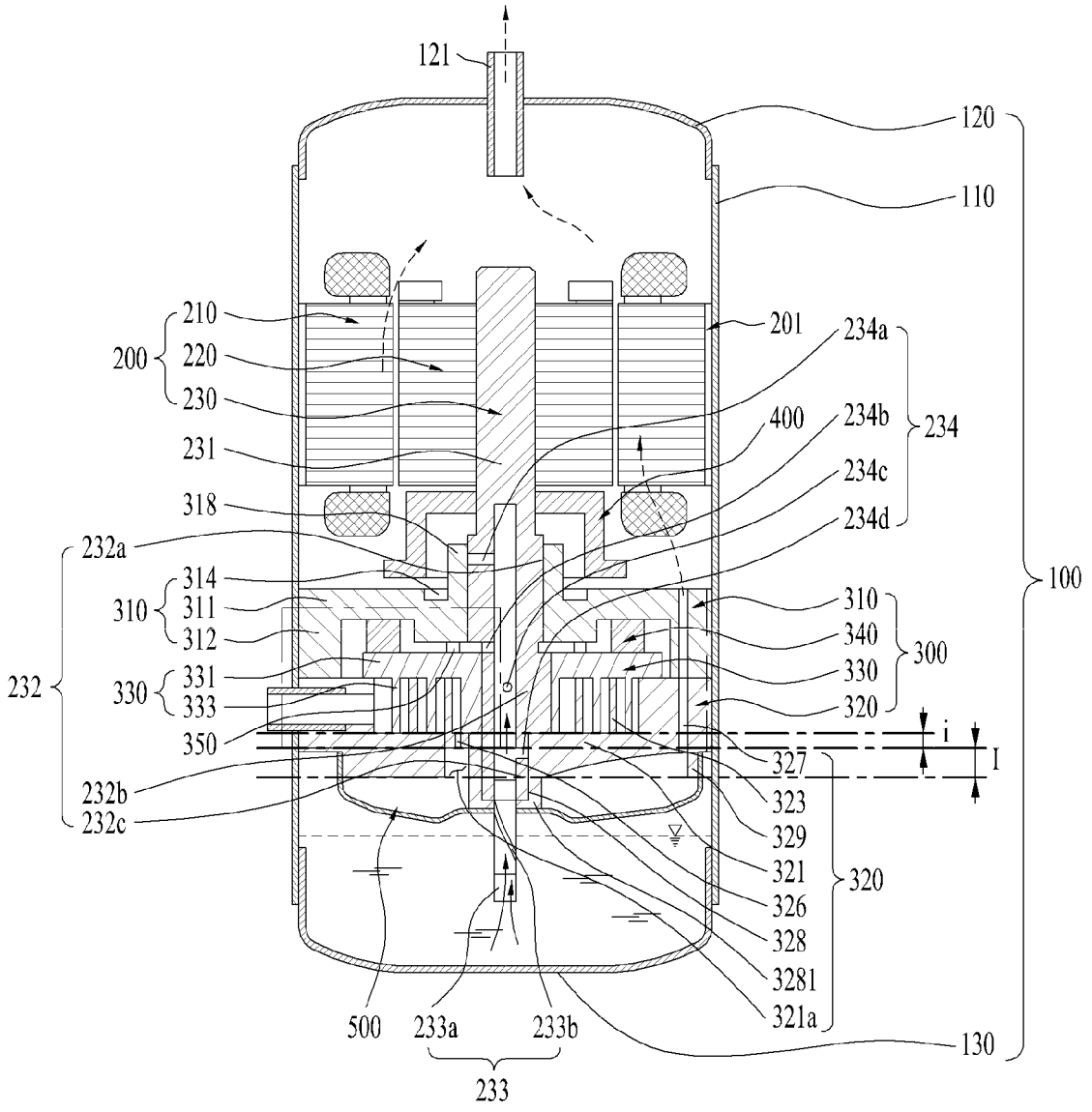
FIG. 1 shows a refrigerant cycle to which a compressor of the present invention is applicable, and a structure of the compressor.

Hereinafter, embodiments of the present disclosure will be described in detail with reference to the accompanying drawings. In the present disclosure, the same or similar reference numerals are given to the same or similar components in different embodiments, and the redundant description thereof is omitted. As used herein, the singular forms "a", "an" and "the" include plural referents unless the context clearly dictates otherwise. In the following description of the embodiments of the present disclosure, a detailed description of known technology will be omitted will be omitted for the purpose of clarity and brevity. In addition, it should be noted that the accompanying drawings are included to provide a further understanding of the embodiments of the present disclosure. The accompanying drawings should not be construed as limiting the technical idea of the present disclosure.

FIG. 1 shows a refrigeration cycle 1 to which a scroll compressor according to one embodiment of the present invention is applied.

Referring to FIG. 1, a refrigeration cycle apparatus to which a scroll compressor 10 according to an embodiment of the present invention is applied may include a scroll compressor 10, a condenser 2 and a condensing fan 2*a*, an expander 3, an evaporator 4 and an evaporation fan 4*a*, which constitute a closed loop.

The scroll compressor 10 according to the embodiment may include a case 100 having a space in which a fluid is stored or flows, a drive unit 200 coupled to an inner circumferential surface of the case 100 to rotate a rotary shaft 230, and a compression unit 300 coupled to the rotary shaft 230 in the case to compress the fluid.

A discharge portion 121 through which a refrigerant is discharged may be provided on one side of the case 100. Specifically, the case 100 may include an accommodation shell 110 formed in a cylindrical shape to accommodate the drive unit 200 and the compression unit 300, and a discharge shell 120 coupled to one end of the accommodation shell 110 and provided with the discharge portion 121, and a shielding shell 130 coupled to the opposite end of the accommodation shell 110 to seal the accommodation shell 110.

The drive unit 200 includes a stator 210 configured to form a rotating field, and a rotor 220 arranged to be rotated by the rotating field. The rotary shaft 230 may be coupled to the rotor 220 so as to rotate together with the rotor 220.

The stator 210 may have multiple slots formed in the inner circumferential surface thereof in a circumferential direction such that a coil is wound on the stator 210. The rotor 220 may be formed of a permanent magnet and be coupled to the inside of the stator 210 to generate rotational power. The rotary shaft 230 may be press-fitted into the center of the rotor 220.

The compression unit 300 may include a fixed scroll 320 coupled to the accommodation shell 110, an orbiting scroll 330 coupled to the rotary shaft to engage with the fixed scroll 320 to form a compression chamber, and a main frame 310 formed to accommodate the orbiting scroll 330 and seated on the fixed scroll 320 to define an outer appearance of the compression unit 300.

In the compressor 10 of the embodiment of the present invention, the drive unit 200 may be arranged between the discharge portion 121 and the compression unit 300.

In other words, the drive unit 200 may be provided on one side of the discharge portion 121 and the compression unit 300 may be provided on the drive unit 200 in a direction away from the discharge portion 121. For example, when the discharge portion 121 is provided in the upper portion of the case 100, the compression unit 300 may be arranged under the drive unit 200, and the drive unit 200 may be arranged between the discharge portion 121 and the compression unit 300.

Thus, the rotary shaft 230 may be supported not only by the main frame 310 and the orbiting scroll 330 but also by the fixed scroll 320, and may be arranged through the fixed scroll 320 so as to protrude to the outside the compression unit 300.

Accordingly, when a fluid such as oil is stored outside the compression unit 300, the stored oil may make a direct contact with the rotary shaft 230. Thus, the oil may be more easily supplied into the compression unit 300.

The rotary shaft 230 may be arranged to make a surface contact with the fixed scroll 320 as well as the orbiting scroll 330. Accordingly, that the rotary shaft 230 may support both gas force (inflow force), which is generated when the fluid flows into the compression unit 300, and reaction force generated when the refrigerant is compressed in the compression unit 300. Thus, axial component of the vibration generated in the orbiting scroll 330 may be prevented, and noise and vibration may be prevented as much as possible by drastically reducing the tilting moment of the orbiting scroll 330.

Further, the rotary shaft 230 may support the back pressure generated when the refrigerant is discharged from the case 100, thereby reducing the normal force that brings the orbiting scroll 330 and the fixed scroll 320 into close contact with each other in the axial direction and greatly reducing the frictional force between the orbiting scroll 330 and the fixed scroll 320.

As a result, the compressor 1 of the present invention may drastically reduce axial rocking and tilting moment of the orbiting scroll 330 in the compression unit 300, thereby reducing the frictional force against the orbiting scroll 300 and greatly enhancing durability the compression unit 300.

In addition, a balancer 400 may be provided between the drive unit 200 and the compressor 300 to sufficiently attenuate vibration. As a result, the rotary shaft may not need to be extended to the outside of the compression unit 300 or to the outside of the drive unit 300 in additionally providing the balancer 400. Further, a plurality of balancers may not need to be arranged at the outer periphery of the drive unit.

Therefore, the volume of the case 100 may be reduced, and arranging the balancer at the end of the rotary shaft 400 may be omitted. Thereby, deformation of the rotary shaft 400 may be prevented. Further, when the case 100 is arranged in a vertical direction or the like, the balancer may be prevented from submerging in the refrigerant or oil provided under the case 100, and thus energy loss may be minimized.

Specifically, the rotary shaft 230 coupled to the drive unit 200 may extend in a direction away from the discharge portion 121 so as to penetrate the main frame 310 and the orbiting scroll 330. In addition, the rotary shaft 230 may be rotatably coupled to the fixed scroll 320.

Here, the rotary shaft 230 may be arranged to penetrate even the fixed scroll 320.

The main frame 310 may include a main head plate 311 arranged on a side of the drive unit 200 facing away from the discharge portion 121 or under the drive unit 200, a main side plate 312 extending from an inner circumferential surface of the main head plate 311 in a direction away from the drive unit 200 and seated on the fixed scroll 330, a main hole 318 formed through the main head plate 311 to accommodate the rotary shaft, and a main shaft accommodation portion 3181 extending from the main hole 318 to rotatably accommodate the rotary shaft 230.

The main head plate 311 or the main side plate 312 may further include a main hole for guiding the refrigerant discharged from the fixed scroll 320 to the discharge portion 121.

The main head plate 311 may further include an oil pocket 314 formed at the exterior of the main shaft accommodation portion 318 in a recessed manner. The oil pocket 314 may be formed in an annular shape and eccentrically disposed in the main shaft accommodation portion 318.

The oil pocket 314 may be formed such that the oil supplied through the rotary shaft 230 is collected and supplied to a portion where the fixed scroll 320 and the orbiting scroll 330 engage with each other.

The fixed scroll 320 may include a fixed head plate 321 coupled to the accommodation shell 110 on a side of the main head plate 311 facing away from the drive unit 300 to form the opposite surface of the compression unit 300, a fixed side plate 322 extending from the fixed head plate 321 toward the discharge portion 121 so as to contact the main side plate 312, and a fixed wrap 323 formed on the inner circumferential surface of the fixed side plate 322 define a compression chamber in which the refrigerant is compressed.

The fixed scroll 320 may include a fixed through hole 328 through which the rotary shaft 230 is arranged, and a fixed shaft accommodation portion 3281 extending from the fixed through hole 328 or the fixed head plate 321 to rotatably support the rotary shaft. The fixed shaft accommodation portion 3281 may be formed at the center of the fixed head plate 321.

The thickness of the fixed head plate 321 may be the same as the thickness of the fixed shaft accommodation portion 3281. Here, the fixed shaft accommodation portion 3281 may not protrude from the fixed head plate 321, but may be inserted into the fixed through hole 328.

The fixed side plate 322 may be provided with an introduction hole 325 for introducing the refrigerant into the fixed wrap 323, and the fixed head plate 321 may be provided with a discharge hole 326 through which the refrigerant is discharged. The discharge hole 326 may be arranged close to the center of the fixed wrap 323, and may be spaced apart from the fixed shaft accommodation portion 3281 in order to avoid interference with the fixed shaft accommodation portion 3281. The discharge hole may include a plurality of discharge holes.

The orbiting scroll 330 may include an orbiting head plate 331 arranged between the main frame 310 and the fixed scroll 320 and an orbiting wrap 331 arranged to define the compression chamber in cooperation with the fixed wrap 323 on the orbiting head plate 331.

The orbiting scroll 330 may further include an orbiting through hole 338 formed through the orbiting head plate 331 such that the rotary shaft 230 is rotatably coupled to the orbiting through hole.

A part of the rotary shaft 230 coupled to the orbiting passage hole 338 may be eccentrically formed. Accordingly, when the rotary shaft 230 rotates, the orbiting scroll 330 may move along the fixed wrap 323 of the fixed scroll 320 in engagement with the fixed scroll 320 to compress the refrigerant, and the compressed refrigerant may be discharged to the discharge hole 326 along the space formed by the fixed wrap 323 and the orbiting wrap 333.

The main frame 310 and the fixed scroll 320 are fixedly coupled to the accommodation shell 110, but the orbiting scroll 320 is arranged to regularly make an orbiting movement on the fixed scroll 320.

To this end, the compression unit 300 may further include an Oldham's ring 340. The Oldham's ring 340 may be arranged between the orbiting scroll 330 and the main frame 310 so as to contact the orbiting scroll 330 and the main frame 310.

The Oldham's ring 340 may be arranged to allow the orbiting scroll 240 make an orbiting movement along the fixed wrap 323 of the fixed scroll 320 while preventing the orbiting scroll 330 from rotating.

It may be more advantageous that the discharge hole 326 is formed to face the discharge portion 121. This is because the refrigerant discharged from the discharge hole 326 can be discharged to the discharge portion 121 without undergoing a significant change in flow direction.

However, since the compression unit 300 is arranged on the side of the drive unit 200 facing away from the discharge portion 121 and the fixed scroll 320 should be arranged at the outermost side of the compression unit 300, the discharge hole 326 is inevitably formed to inject the refrigerant in a direction opposite to the discharge portion 121.

In other words, the discharge hole 326 is formed in the fixed head plate 321 to discharge the refrigerant in the direction away from the discharge portion 121.

If the refrigerant is directly injected into the discharge hole 326, the refrigerant may not be discharged smoothly to the discharge portion 121. Further, if there is oil or the like on one side or the lower portion of the compression unit 300, there is a possibility that the refrigerant collides with the oil and is cooled.

To prevent such issues, the compressor 10 may further include a muffler 500 coupled to an outermost portion of the fixed scroll 320 to provide a space for guiding the refrigerant to the discharge portion 121.

The muffler 500 may be arranged to seal one surface of the fixed scroll 320 arranged on a side facing away from the discharge portion 121 so as to guide the refrigerant discharged from the fixed scroll 320 to the discharge portion 121.

Accordingly, the refrigerant injected from the discharge hole 326 may be discharged to the discharge portion 121 as it is diverted along the inner surface of the muffler 500.

Since the fixed scroll 320 is coupled to the accommodation shell 110, and thus the refrigerant may be restricted from moving to the discharge portion 121 due to the interference of the fixed scroll 320, the fixed scroll 320 may further include a bypass hole 327 that allows the refrigerant passing through the fixed head plate 321 to pass through the fixed scroll 320.

The bypass hole 327 may be formed to communicate with the main hole 318. Accordingly, the refrigerant may pass through the compression unit 300 and be discharged to the discharge portion 121 via the drive unit 200.

Since the refrigerant is compressed at a higher pressure so as to move toward the inside from the outer circumferential surface of the fixed wrap 323, the inside of the fixed wrap 323 and the orbiting wrap 333 may be classified into a high-pressure area, and the outer circumferential surface of the orbiting wrap 323 and the orbiting wrap 333 may be classified into an intermediate-pressure area.

Both the high-pressure area and the intermediate-pressure area may also be formed in the space surrounded by the rotary shaft 230, the main frame 310, and the orbiting scroll 330.

A back pressure seal may be provided between the main frame 310 and the orbiting scroll 330 in order to divide the space surrounded by the rotary shaft 230, the main frame 310 and the orbiting scroll 330 into a high-pressure area and an intermediate-pressure area. The back pressure seal 350 may serve as a sealing member.

The case 100 may be provided at one side with oil stored therein for lubricating the compression unit 300. The oil may be supplied to the compression unit 300 through the rotary shaft 260 due to a pressure difference between the high pressure and the intermediate pressure.

Hereinafter, a structure for supplying oil to the rotary shaft 230 and the compression unit 300 will be described in detail.

The rotary shaft 230 may be coupled to the drive unit 200 and may include an oil supply passage 234 for guiding the oil provided on one side or the lower portion of the case 100 to an upper portion.

Specifically, one end or an upper end of the rotary shaft 230 may be press-fitted to the center of the rotor 220, and the opposite end or the lower end thereof may be coupled to the compression unit 300 and radially supported.

Thus, the rotary shaft 230 may transmit the rotational power of the drive unit 200 to the orbiting scroll 330 of the compression unit 300.

The rotary shaft 230 may include a main shaft 231 rotated by the drive unit 200 and a bearing unit 232 coupled to the outer circumferential surface of the main shaft 231 to support the main shaft 231 such that the main shaft 231 rotates smoothly.

The bearing unit 232 may be formed as a member separate from the main shaft 231 or may be integrated with the main shaft 231.

The bearing unit 232 may include a main bearing part 232*a* inserted into and radially supported by the main shaft accommodation portion 3181 of the main frame 310, a fixed bearing part 232*c* inserted into and radially supported by the fixed shaft accommodation portion 3281 of the fixed scroll 320, and an eccentric part 232*b* arranged between the main bearing part 232*a* and the fixed bearing part 232*c* and inserted into and coupled to the orbiting through hole 338 of the orbiting scroll 330.

The main bearing part 232*a* and the fixed bearing part 232*a* may be coaxially formed so as to have the same axial center, and the eccentric part 232*b* is arranged so as to be radially eccentric with respect to the main bearing part 232*a* or the fixed bearing part 232*c*.

The eccentric part 232*b* may have an outer diameter smaller than an outer diameter of the main bearing part 232*a* and larger than an outer diameter of the fixed bearing part 232*c*. This configuration may be advantageous in coupling the rotary shaft 230 through the respective shaft accommodation portions 3181, 3281, 338.

The eccentric part 232*b* may not be integrated with the rotary shaft 230, but may be formed using a separate bearing. In this case, the rotary shaft 230 may be coupled by passing through the respective shaft accommodation portions 3181, 3281, 338 even when the fixed bearing part 232*c* is not formed to have an outer diameter smaller than the outer diameter of the eccentric part 232*b*.

The rotary shaft 230 may be provided with an oil supply passage 234 for supplying the oil to the outer circumferential surface of the main bearing part 232*a*, the outer circumferential surface of the fixed bearing part 232*c*, and the circumferential surface of the eccentric part 232*b*.

The rotary shaft 230 may also be provided with a plurality of oil holes 234*a*, 234*b*, 234*c*, and 234*d* formed through the outer circumferential surface of the main bearing part 232*a*, the outer circumferential surface of the fixed bearing part 232*c*, and the outer circumferential surface of the eccentric part 232*b*.

Specifically, the oil holes may include a first oil hole 234*a*, a second oil hole 234*b*, a third oil hole 234*d*, and a fourth oil hole 234*e*.

The first oil hole 234*a* may be formed through the outer circumferential surface of the main bearing part 232*c*.

Specifically, the first oil hole 234*a* may be formed from the oil supply passage 234 to the outer circumferential surface of the main bearing part 232*a* in a penetrating manner.

Further, the first oil hole 234*a* may be formed to penetrate an upper portion of the outer circumferential surface of the main bearing part 232*a*, but is not limited thereto.

That is, it may be formed to penetrate a lower portion of the outer circumferential surface of the main bearing part 232*a*.

For reference, the first oil hole 234*a* may include a plurality of holes, unlike the one shown in the drawing.

When the first oil hole 234*a* includes a plurality of holes, the holes may be formed only in the upper or lower portion of the outer circumferential surface of the main bearing part 232*a*, or may be formed in both the upper and lower portions of the outer circumferential surface of the main bearing part 232*a*.

The rotary shaft 230 may include an oil feeder 233 arranged through the muffler 500 to contact the oil stored in the case 100. The oil feeder 233 may include an extension shaft 233*a* arranged through the muffler 500 and contacting the oil and a spiral groove 233*b* formed on the outer circumferential surface of the extension shaft 233*a* in a spiral shape so as to communicate with the supply passage 234.

Accordingly, when the rotary shaft 230 rotates, the oil rises through the oil feeder 233 and the supply passage 234 due to the spiral groove 233*b*, the viscosity of the oil, and a difference in pressure between the high-pressure area and the intermediate-pressure area in the compression unit 300, and is discharged to the plurality of oil holes.

The oil discharged through the plurality of oil holes 234*a*, 234*b*, 234*d* and 234*e* may form an oil film between the fixed scroll 250 and the orbiting scroll 240 to maintain the airtight state, and may absorb and dissipate the heat of friction generated between the components of the compression unit 300.

Specifically, the high-pressure oil guided along the rotary shaft 230 may be supplied through the first oil hole 234*a* to lubricate the main frame 310 and the rotary shaft 230.

The oil may be discharged through the second oil hole 234*b* and supplied to the top surface of the orbiting scroll 240. The oil supplied to the top surface of the orbiting scroll 240 may be guided to the intermediate-pressure chamber through the oil pocket 314.

For reference, the oil discharged through the first oil hole 234*a* or the third oil hole 234*d* as well as the second oil hole 234*b* may be supplied to the oil pocket 314.

The oil guided to the intermediate-pressure chamber may be supplied to the Oldham's ring 340, which is arranged between the orbiting scroll 240 and the main frame 230, and the fixed side plate 322 of the fixed scroll 320. Thereby, wear of the fixed side plate 322 of the fixed scroll 320 and the Oldham's ring 340 may be reduced.

In addition, the oil supplied to the third oil hole 234*c* may be supplied to the compression chamber, thereby reducing wear of the orbiting scroll 330 and the fixed scroll 320 caused by friction there between. Further, the oil may form an oil film and dissipate heat, thereby improving the compression efficiency.

While the compressor 10 is illustrated as having a centrifugal oil supply structure in which oil is supplied to the bearings using rotation of the rotary shaft 230, this is merely an embodiment. The compressor 10 may employ a differential pressure oil supply structure in which oil is supplied using the difference in pressure in the compressor 300, and a forced oil supply structure in which oil is supplied through a trochoid pump.

As the refrigerant is discharged to the discharge portion 121, the oil supplied to the compression unit 300 or the oil stored in the case 100 may move to an upper portion of the case 100 together with the refrigerant.

At this time, the oil cannot move to the discharge portion 121, and is attached to the discharge shell 110 and the inner wall of the accommodation shell 120 because the oil is denser than the refrigerant and thus.

The drive unit 200 and the compression unit 300 may be provided with a recovery passage on the outer circumferential surface thereof to return the oil attached to the inner wall of the case 100 to the oil reservoir space of the case 100 or the shielding shell 130.

Figure 2A:
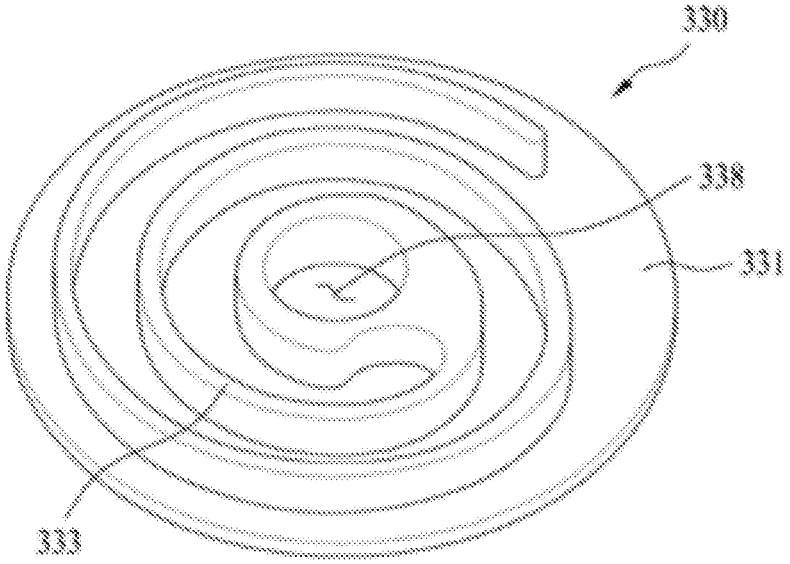
FIGS. 2A and 2B show the structure of a scroll of the compressor of the present invention.
Figure 2B:
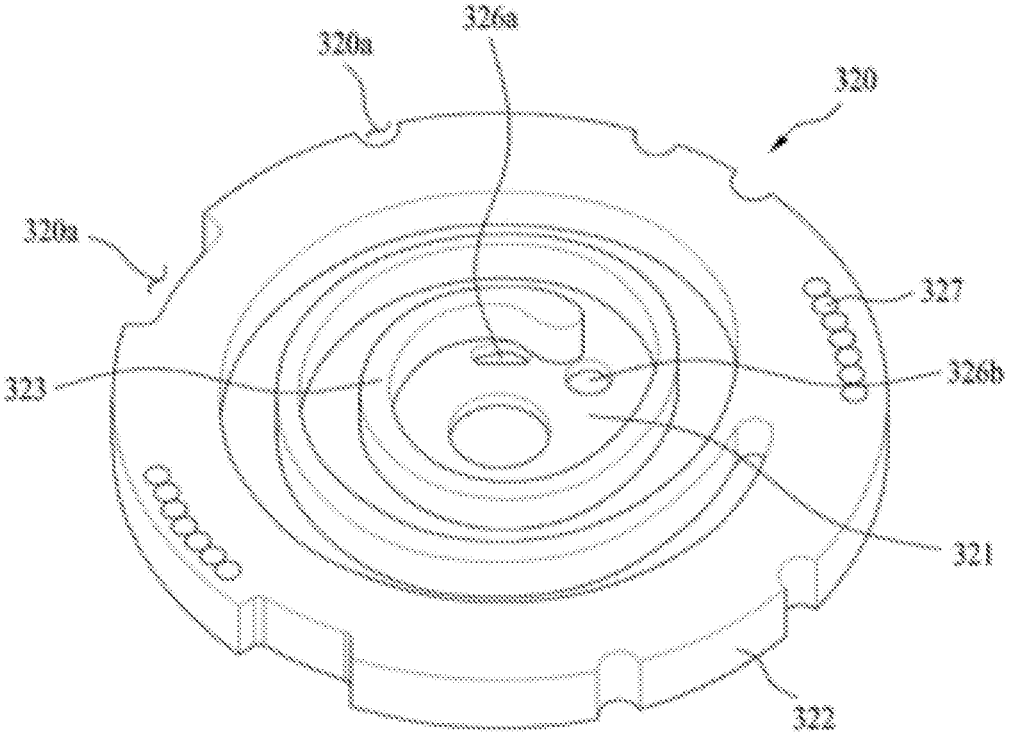

FIGS. 2A and 2B show the structure of the orbiting scroll 330 and the fixed scroll 320 of the compressor 10 of the present invention.

FIG. 2A shows the orbiting scroll, and FIG. 2B shows the fixed scroll.

The orbiting scroll 330 may include the orbiting wrap 333 formed on one surface of the orbiting head plate 331 and the fixed scroll 320 may include the fixed wrap 323 formed on one surface of the fixed head plate 321.

The orbiting scroll 330 may be formed as a rigid body which is sealed to prevent the refrigerant from being discharged to the outside, but the fixed scroll 320 may include an introduction hole 325 communicating with a refrigerant supply pipe to allow introduction of a low-temperature and low-pressure refrigerant in a liquid state or the like, and a discharge hole 326 through which the high-temperature and high-pressure refrigerant is discharged. A bypass hole 327 through which the refrigerant discharged from the discharge hole 326 is discharged may be formed in the outer circumferential surface of the fixed scroll 320.

The fixed wrap 323 and the orbiting wrap 333 may be formed in an involute shape so as to form a compression chamber in which the refrigerant is compressed, as the wraps are engaged with each other at least two points.

The involute shape refers to a curve corresponding to a trajectory of an end of a thread wound around a base circle having an arbitrary radius that is formed when the thread is released, as shown in the drawing.

However, the fixed wrap 323 and the orbiting wrap 333 of the present invention are formed by combining 20 or more arcs, and thus the radius of curvature may vary among the parts of the wraps.

That is, in the compressor of the present invention, the rotary shaft 230 is arranged to extend through the fixed scroll 320 and the orbiting scroll 330, and thus the radius of curvature and the compression space of the fixed wrap 323 and the orbiting wrap 333 are reduced.

Accordingly, in order to compensate for the reduction, the compressor of the present invention has a structure in which the space through which the refrigerant is discharged is narrowed. In addition, the radius of curvature of the fixed wrap 323 and the orbiting wrap 333 immediately before discharging is reduced below the radius of the penetrated shaft accommodation portion of the rotary shaft to improve a compression ratio.

That is, the fixed wrap 323 and the orbiting wrap 333 may be bent to a larger extent near the discharge hole 326, and the radius of curvature of the wraps may vary from point to point according to the curved parts as the wraps extend toward the introduction hole 325.

Figure 3:
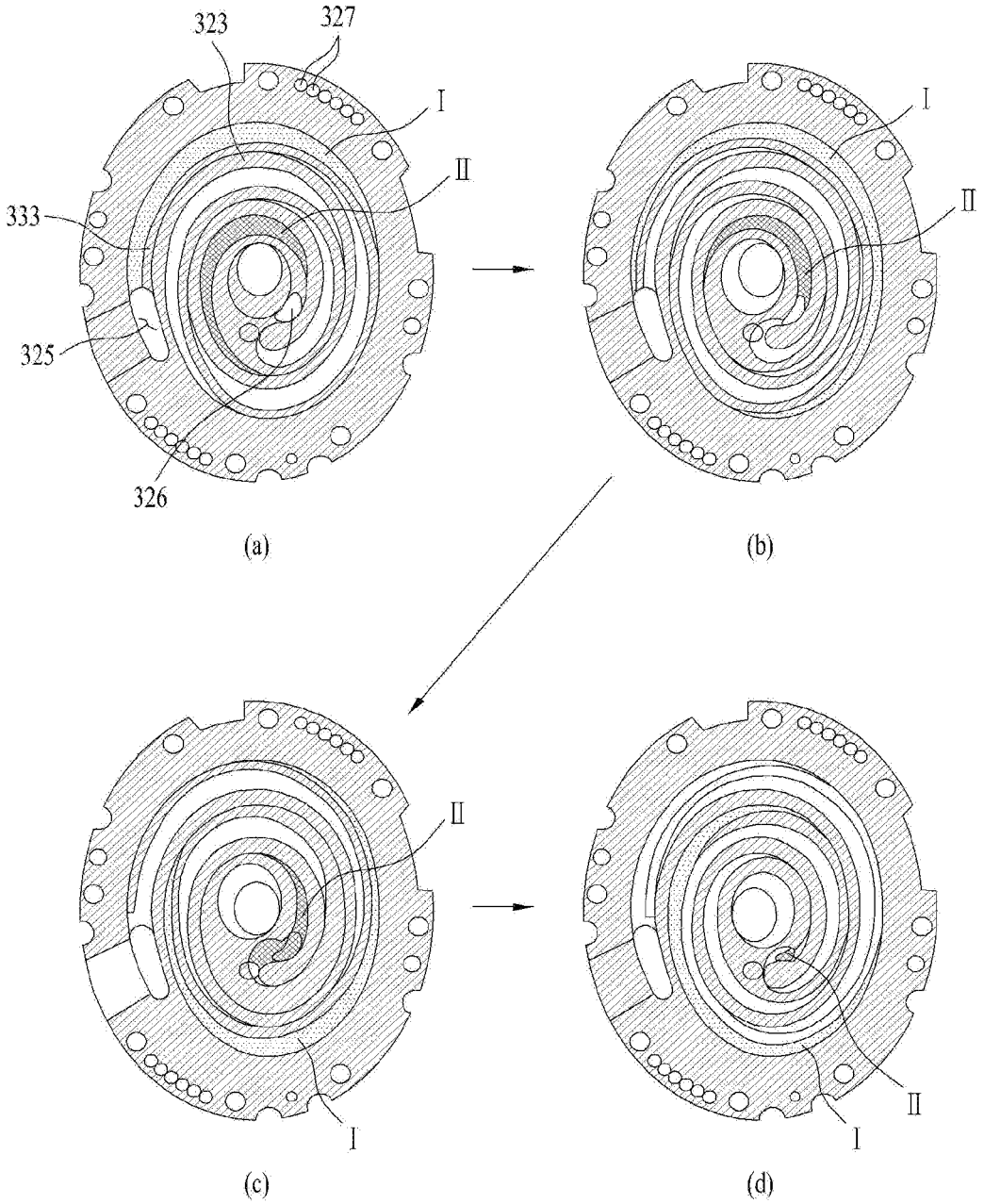
FIG. 3 shows the operation principle of the compressor of the present invention.

FIG. 3 illustrates a process of compressing the refrigerant while the fixed scroll 320 and the orbiting scroll 330 are engaged with each other.

Referring to (a) of FIG. 3, the refrigerant I flows into the introduction hole 325 of the fixed scroll 320 and the refrigerant II introduced before the refrigerant I flows into the fixed scroll 320 is located in the vicinity of the discharge hole 326.

At this time, the refrigerant I is present in an area where the rotating wrap 333 is engaged with the outer surface of the fixed wrap 323, and the refrigerant II is sealed in another area where the fixed wrap 323 is engaged with the orbiting wrap 333 at two points.

Referring to (b) of FIG. 3, when the orbiting scroll 330 starts to make an orbiting movement thereafter, the area where the fixed wrap 323 is engaged with the orbiting wrap 333 at two points is moved along the extension direction of the orbiting wrap 333 according to change in position of the orbiting wrap 333. Thereby, the volume is starts to be reduced, and the refrigerant I starts to move to be compressed. The refrigerant II starts to be compressed and guided to the discharge hole 327 as the volume thereof is further reduced.

Referring to (c) of FIG. 3, the refrigerant II is discharged from the discharge hole 327, and the refrigerant I moves and starts to be further compressed along with reduction of the volume thereof as the area where the fixed wrap 323 is engaged with the orbiting wrap 333 at two points moves clockwise.

Referring to (d) of FIG. 3, as the area where the fixed wrap 323 is engaged with the orbiting wrap 333 at two points moves further clockwise, the area is positioned closer to the inside of the fixed scroll, the refrigerant (II) is compressed with the volume further reduced and is almost completely discharged.

As described above, as the orbiting scroll 330 makes an orbiting movement, the refrigerant may be linearly or continuously compressed while moving into the fixed scroll.

Although the refrigerant is illustrated in the figures as non-continuously flowing into the introduction hole 325, this is merely an example. The refrigerant may be continuously supplied, and may be accommodated and compressed in each area where the fixed wrap 323 is engaged with the orbiting wrap 333 at two points.

Hereinafter, variation of the compressor efficiency with the length of the discharge hole 326 provided in the fixed scroll 320 will be described with reference to FIGS. 4A to 5B.

Figure 4A:
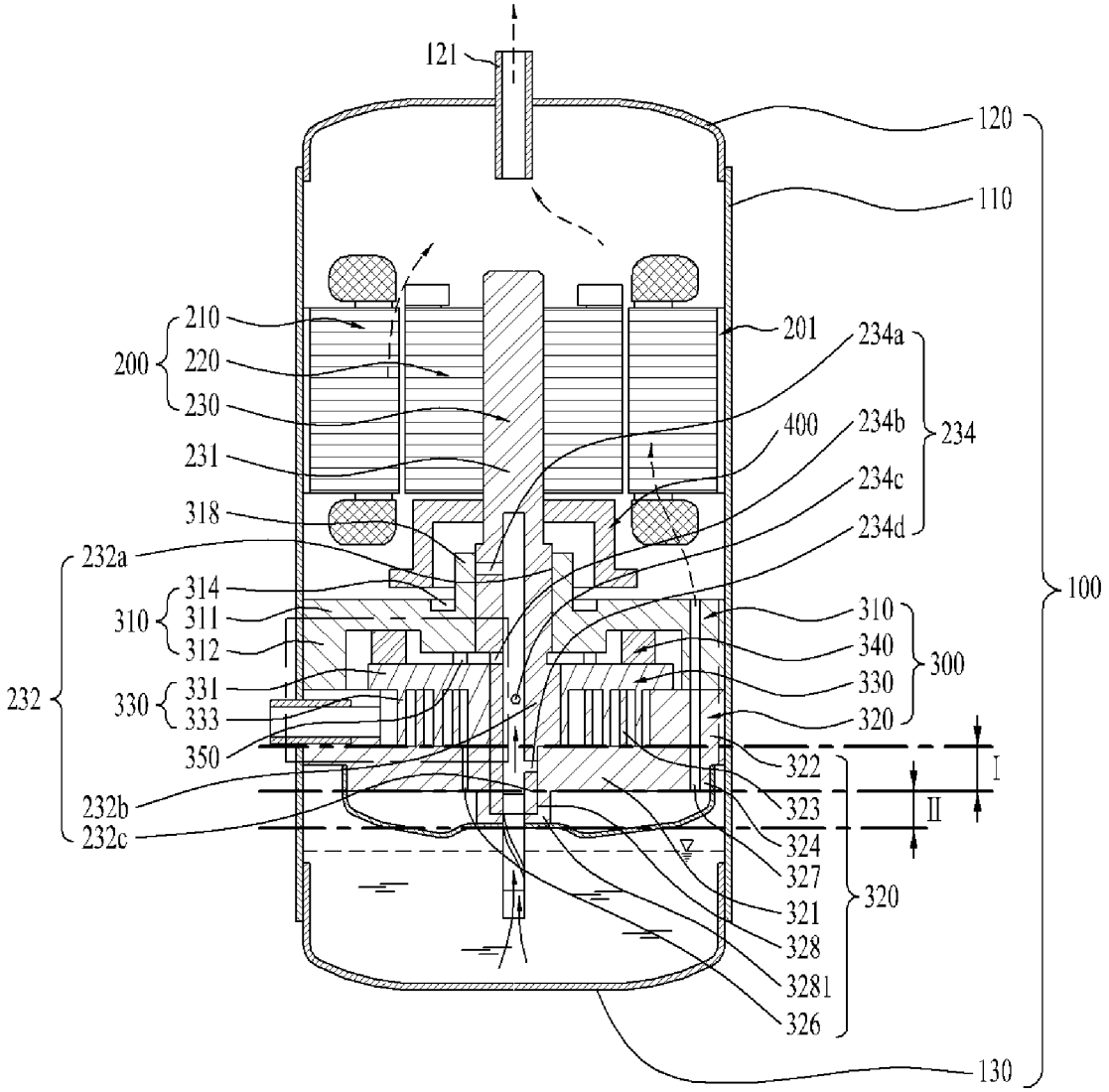
FIGS. 4A and 4B illustrate one embodiment of the compressor of the present invention compared with the structure of a conventional compressor.
Figure 4B:
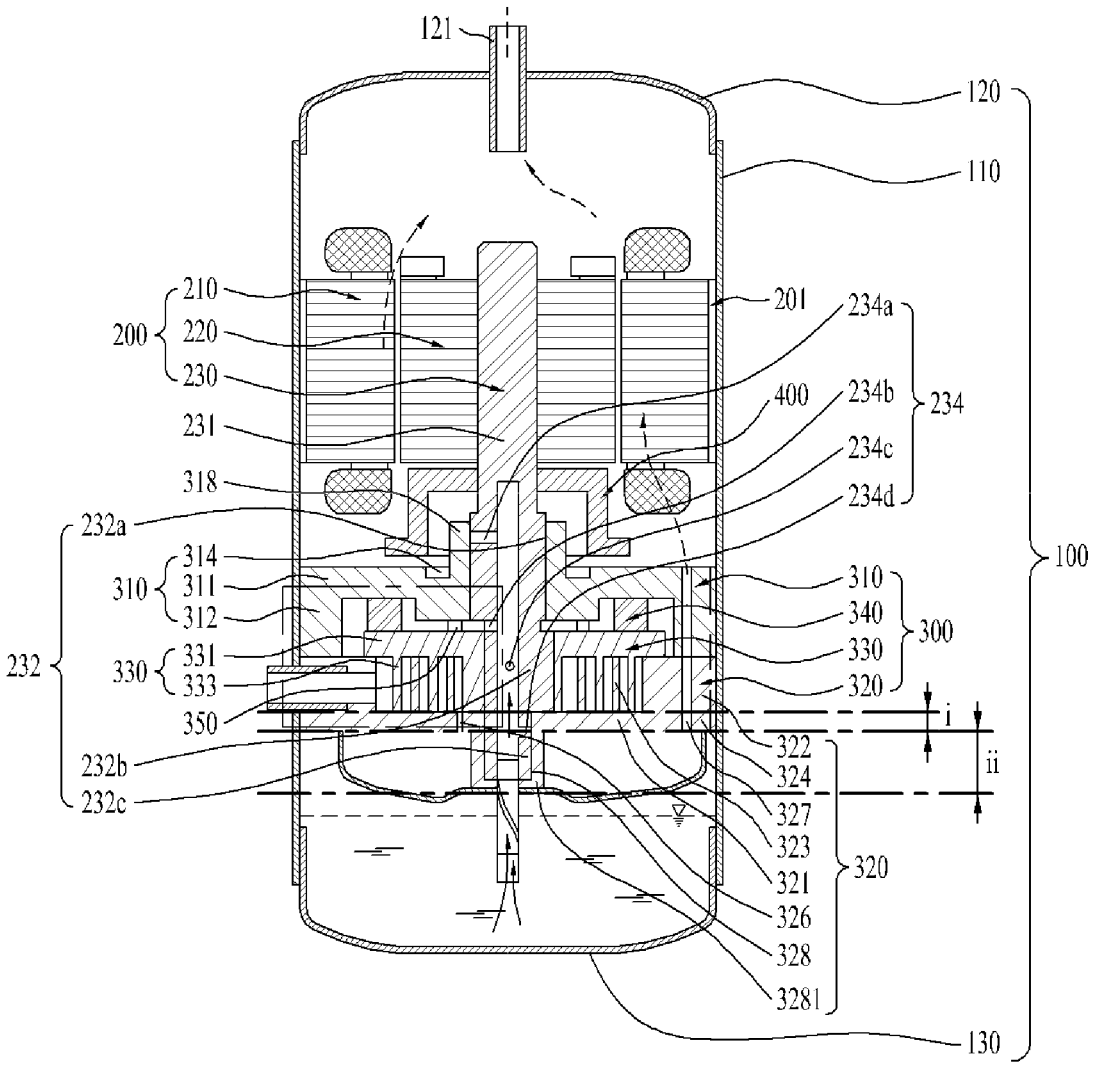
Figure 5A:
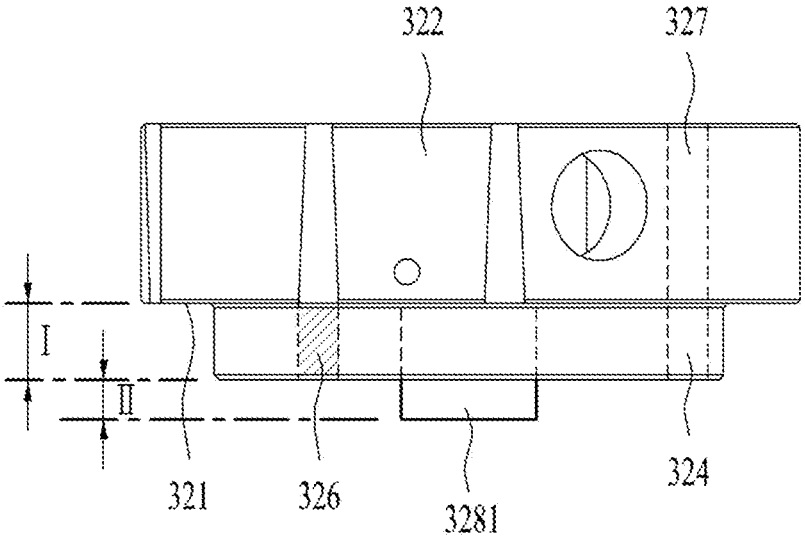
FIGS. 5A and 5B show the structures of the fixed scrolls of the conventional compressor and the compressor of the present invention.
Figure 5B:
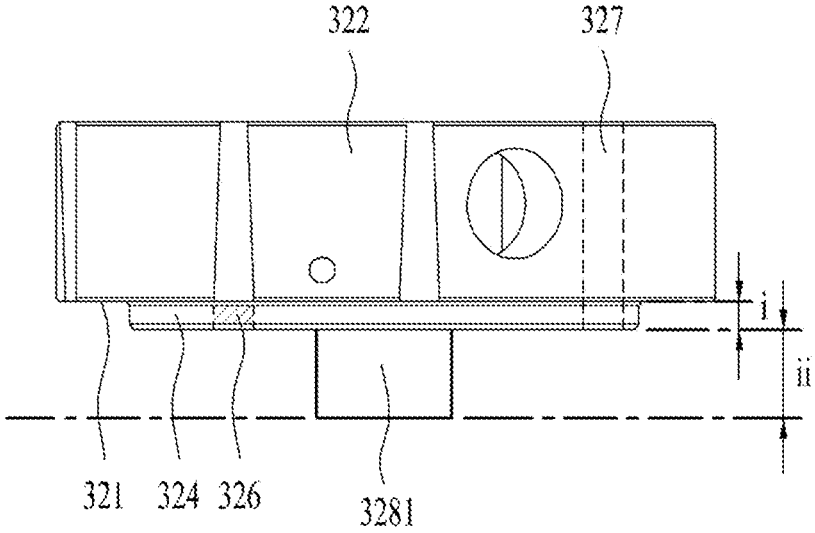

FIGS. 4A and 4B show the overall structure of the compressor, and FIGS. 5A and 5B show an enlarged view of the fixed scroll.

FIGS. 4A and 5A show an embodiment of the compressor in which the length I of the discharge hole 326 provided in the fixed head plate 321 is longer than the length II of the fixed shaft accommodation portion 328 provided in the fixed head plate 321.

Referring to FIGS. 4A and 5A, the refrigerant compressed between the fixed scroll 320 and the orbiting scroll 330 passes through the discharge hole 326 and is discharged to the muffler 500. Thereafter, the refrigerant flows through the space formed by the muffler 500 and the fixed head plate 321, flows into the bypass hole 327, and is finally discharged to the discharge portion 121 through the drive unit 200.

Since the rotary shaft 230 is inserted into and rotatably accommodated in the fixed head plate 321 or the fixed head plate 321 is provided with the fixed shaft accommodation portion 3281 configured to rotatably support the fixed bearing part 232*a*, the fixed head plate 321 may be thickly formed so as to accommodate one end of the rotary shaft 230 or most of the area of the fixed bearing part 232*a*.

In the case where a coupling portion 324 protruding from one surface of the fixed head plate 321 and coupled with the muffler 500 is provided, the area of the coupling portion 324 that is coupled with the muffler 500 may be widened according to increase in thickness of the coupling portion 324, thereby improving the installation stability.

As a result, it is advantageous that the fixed head plate 321 is thickly formed such that the length II by which the fixed shaft accommodation portion 3281 protrudes from the fixed head plate 321 is less than the length I of the discharge hole.

However, since the discharge hole 326 is formed through the fixed head plate 321 as shown in FIG. 4A, accordingly the axial length I of the discharge hole 326 increase as the thickness of the fixed head plate 321 increases.

That is, as the refrigerant discharged from the fixed wrap 323 passes through the discharge hole 326, and the area of contact with the fixed head plate 321 becomes larger. Accordingly, when the refrigerant is discharged, the friction loss and the discharge loss may increase, resulting in lowered efficiency of the compressor.

Further, according to the structure of the fixed head plate 321, since the length of the bypass hole 327 increases according to increase of the axial length I of the discharge hole, the area of the refrigerant in contact with the fixed head plate 321 may become larger as the refrigerant passes through the bypass hole 327. Thereby, friction loss and flow loss may be produced.

The refrigerant is compressed through the fixed wrap 323 and the orbiting wrap 333, and compression of the refrigerant is not affected by the orbiting head plate 331 and the fixed head plate 321. Accordingly, as the orbiting head plate 331 or the fixed head plate 321 becomes thicker, the durability of the orbiting head plate 331 or the fixed head plate 321 may be improved, but an area that does not contribute to compression of the refrigerant in the compression unit 300 becomes larger.

Further, as the thickness of the fixed head plate 321 increases, the mass of the fixed scroll 320 increases, and the heat capacity increases in proportion thereto. Thereby, the amount of heat energy of the refrigerant compressed at a high temperature and a high pressure and absorbed increases. As a result, as the thickness of the fixed head plate 321 provided on the fixed wrap 323 increases, the dead volume may correspondingly increase, thereby lowering the efficiency of the compressor.

Further, as the fixed head plate 321 becomes thicker, the distance between the distal end of the discharge hole 326 and the inner wall of the muffler 500 is reduced, and accordingly the energy by which the discharged refrigerant collides with the muffler 500 may increase, resulting in lowered efficiency of the compressor.

FIGS. 4B and 5B show one embodiment of a compressor capable of reducing the length of the discharge hole 326 to improve the performance of the compressor.

Referring to FIGS. 4B and 5B, the axial length i of the discharge hole 326 in the fixed scroll 320 of the compressor 10 of the present invention may be shorter than the axial length ii of the fixed shaft accommodation portion 3281.

In other words, the fixed shaft accommodation portion 3281 may further extend outward from the fixed head plate 321, and the length i of the discharge hole 326 may be further decreased.

The axial length i of the discharge hole may be less than the length ii by which the fixed shaft accommodation portion 3281 protrudes from the fixed head plate 321. Here, in order to improve durability of the fixed shaft accommodation portion 3281, the thickness in the radial direction of the fixed shaft accommodation portion 3281 may be increased.

The length i from the fixed wrap 323 to the distal end of the discharge hole 326 may be less than the length ii from the fixed wrap 323 to the distal end of the fixed shaft accommodation portion 3281. In other words, the length from the exposed surface of the fixed wrap 323 to the distal end of the discharge hole 326 may be less than the length from the exposed surface of the fixed wrap 323 to the distal end of the fixed shaft accommodation portion 3281.

As a result, the length i of the discharge hole 326 may be shortened, and thus the length by which the refrigerant passes through or contacts the fixed head plate 321 may be shortened. Therefore, the frictional loss and discharge loss of the refrigerant generated in the discharge hole 326 may be greatly reduced, and the performance and efficiency of the compressor may be increased.

At the same time, the length of the bypass hole 327 may also be reduced, and accordingly the frictional loss of the refrigerant may be further reduced.

Here, the overall thickness of the fixed scroll 320 may be maintained to be the same as when the length i of the discharge hole is greater than the length of the fixed shaft accommodation portion 3281. Accordingly, the overall length of the fixed shaft accommodation portion 3281 may be maintained, and therefore that the coupling force and durability for supporting the rotary shaft 230 may be maintained.

In another respect, the thickness of the fixed head plate 321 may be reduced. In other words, the thickness of the coupling portion 324 of the fixed head plate 321 may be reduced. In some cases, the thickness of the fixed head plate 321 may be less than the thickness or length of the fixed shaft accommodation portion 3281. As the thickness of the fixed head plate 321 or the thickness i of the coupling portion 324 is reduced, the volume of the fixing head plate 321 may be reduced. Since the reduced volume is a region that is irrelevant to compression of the refrigerant and is configured to absorb unnecessary heat, the dead volume corresponding to the thickness difference I–i of the fixed head plate 321 may be greatly reduced. As the dead volume is reduced, the loss occurring in the dead volume may be greatly reduced.

Thereby, the efficiency of the compressor may be further increased.

In brief, as the length i of the discharge hole 326, the thickness i of the coupling portion, and the length of the bypass hole 327 are less than the length ii of the fixed shaft accommodation portion 3281, the efficiency of the compressor may be increased.

In addition, the distance between the exposed surface of the fixed head plate 321 and the muffler 500 may become longer, and the space formed by the muffler 500 may be further expanded.

Accordingly, the refrigerant discharged from the discharge hole 326 does not immediately collide with the muffler 500, but may move further by a reduced length to contact the muffler 500.

As a result, energy lost when the refrigerant discharged from the discharge hole 326 collides with the muffler 500 may be reduced, and the efficiency of the compressor may be increased.

Figure 6:
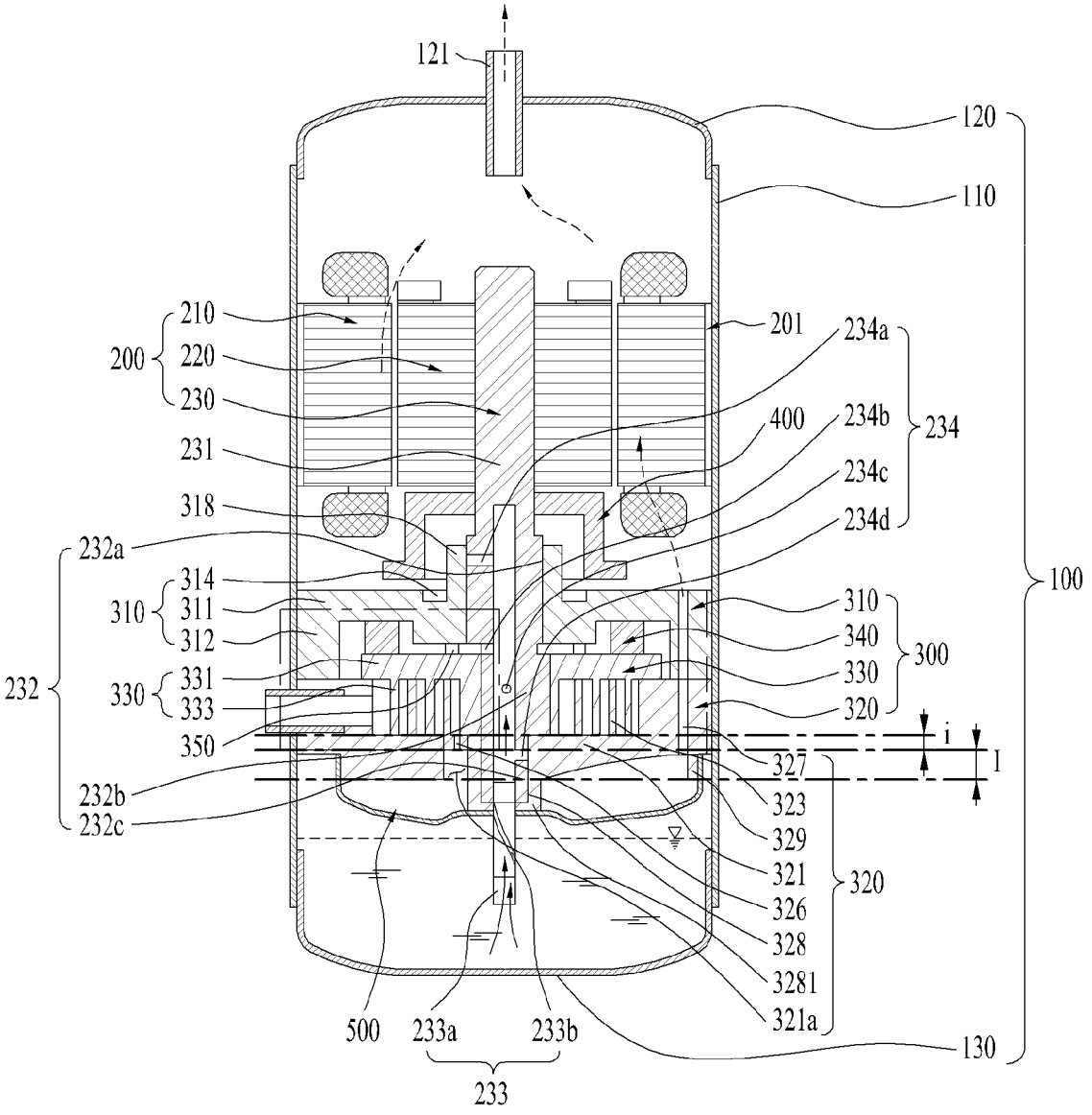
FIG. 6 shows another embodiment of the compressor of the present invention.

FIG. 6 shows another embodiment in which the structure of the fixed head plate 321 is changed to improve performance of the compressor.

The compressor 10 of the present invention may further include a depressed portion 321*a*, which is formed by curving a portion of the fixed head plate 321 provided with the discharge hole 326.

The depressed portion 321*a* may bring about an effect of reducing the length i of the discharge hole 326 below the thickness I of the fixed head plate 321.

Thus, the effect of reducing the length i of the discharge hole may be obtained while maintaining the thickness (I+i) of the fixed head plate 321.

As shown in FIG. 6, the depressed portion 321*a* may have a constant width, but the slope thereof may become steeper or more parallel to the rotary shaft 230 as the distance from the discharge hole 326 increases.

Accordingly, the refrigerant discharged from the discharge hole 326 may flow in an agglomerate state without being diffused in the muffler 500.

In contrast with the illustrated example, the depressed portion 321*a* may be formed such that the slope thereof becomes gentler or more parallel to the fixed head plate 321 as the distance from the discharge hole 326 increases.

Thus, the refrigerant discharged from the discharge hole 326 may be supplied to the muffler 500 without being accumulated.

The distance between the bypass hole 327 and the muffler 500 may be longer than the distance between the distal end of the fixed shaft accommodation portion 328 and the muffler 500.

The fixed head plate 321 may further include a concave portion 321*b* formed to have a thickness decreasing from the fixed shaft accommodation portion 3281 to the bypass hole 327. Accordingly, the refrigerant discharged from the discharge hole 326 may smoothly flow into the bypass hole 327 along the surface of the concave portion.

The concave portion 321*b* may be convex upward with respect to the shielding shell 130 as it extends from the center of the fixed head plate 321 toward the fixed side plate 322.

Thereby, the refrigerant may be guided so as to more smoothly flow into the bypass hole 327.

The fixed head plate 321 may further include a guide 329 protruding from the outer side and the outer periphery of the bypass hole 327 to guide the refrigerant to the bypass hole 327.

The cross section of the guide 329 may be formed in the shape of a protruding rib. Accordingly, the guide 329 may prevent the refrigerant from moving to the outside of the bypass hole 327 and guide the refrigerant so as to more smoothly flow into the bypass hole 327.

As apparent from the above description, the present invention has effects as follows.

According to embodiments of the present invention, a length of flow of a refrigerant inside a fixed scroll may be minimized by reducing the thickness of a head plate of the fixed scroll. Thereby, the discharge loss may be reduced.

According to embodiments of the present invention, a volume irrelevant to compression of the refrigerant may be eliminated by reducing the thickness of the head plate of the fixed scroll. Thereby, the dead volume loss may be reduced.

According to embodiments of the present invention, a length of spacing between a discharge hole of the fixed scroll through which the refrigerant is discharged and a muffler extended. Thereby, the flow loss may be reduced.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A compressor comprising:

a case comprising a discharge portion disposed at one side of the case, the discharge portion being configured to discharge refrigerant from the case;

a drive unit coupled to an inner circumferential surface of the case;

a rotary shaft that extends from the drive unit in a direction away from the discharge portion and that is configured to rotate about an axis;

an orbiting scroll coupled to the rotary shaft and configured to rotate based on a rotation of the rotary shaft;

a fixed scroll engaged with the orbiting scroll, the fixed scroll defining a compression space configured to receive, compress, and discharge refrigerant; and a muffler that is coupled to the fixed scroll, and that defines a receiving space configured to guide refrigerant toward the discharge portion, wherein the fixed scroll comprises:

a fixed head plate that is coupled to the inner circumferential surface of the case and that defines the compression space, and a fixed shaft accommodation portion that is configured to accommodate the rotary shaft, wherein the fixed head plate defines:

a discharge hole that extends through the fixed head plate and that is configured to discharge compressed refrigerant toward the receiving space of the muffler, and a bypass hole that extends through the fixed head plate and that is configured to guide refrigerant in the receiving space of the muffler toward the discharge portion, wherein the fixed shaft accommodation portion includes a protruding portion that protrudes from the fixed head plate toward the muffler, wherein the discharge hole is spaced apart from the fixed shaft accommodation portion and extends through the fixed head plate in an axial direction, and wherein a thickness of the fixed head plate in the axial direction is less than a thickness of the protruding portion of the fixed shaft accommodation portion in the axial direction.

2. The compressor of claim 1, wherein the orbiting scroll comprises an orbiting wrap disposed at one surface of the orbiting scroll, wherein the fixed head plate comprises a fixed wrap coupled to the orbiting wrap, the fixed head plate having an exposed surface facing the muffler, and wherein a distance from the exposed surface of the fixed head plate to a distal end of the discharge hole facing the discharge portion is less than a distance from the exposed surface of the fixed head plate to a distal end of the fixed shaft accommodation portion facing the muffler.

3. The compressor of claim 1, wherein the fixed head plate comprises a depressed portion that extends from the discharge hole toward the muffler and that penetrates a portion of the fixed head plate.

4. The compressor of claim 3, wherein a diameter of the depressed portion is greater than a diameter of the discharge hole.

5. The compressor of claim 4, wherein the depressed portion defines a slope with respect to the rotary shaft, and wherein the slope of the depressed portion increases as a distance from the discharge hole to the depressed portion increases.

6. The compressor of claim 4, wherein the depressed portion defines a slope with respect to the rotary shaft, and wherein the slope of the depressed portion decreases as a distance from the discharge hole to the depressed portion increases.

7. The compressor of claim 1, wherein a distance between a distal end of the bypass hole and a surface of the muffler is greater than a distance between the surface of the muffler and a distal end of the fixed shaft accommodation portion facing the muffler.

8. The compressor of claim 1, wherein the fixed head plate further comprises:

a guide that protrudes from the fixed head plate toward the muffler, that is disposed radially outward of the bypass hole, and that is configured to guide refrigerant to the bypass hole.

9. The compressor of claim 1, wherein the bypass hole is located radially outward of the discharge hole.

10. The compressor of claim 1, wherein the discharge hole is disposed radially outward of the fixed shaft accommodation portion, and the bypass hole is located radially outward of the discharge hole.

11. The compressor of claim 1, wherein the fixed head plate comprises:

a depressed portion that extends from the discharge hole through the fixed head plate in the axial direction; and a concave portion that is recessed toward the discharge portion from an exposed surface of the fixed head plate facing the muffler.

12. The compressor of claim 11, wherein the depressed portion is defined at a first side of the fixed head plate with respect to the rotary shaft, and wherein the concave portion is defined at a second side of the fixed head plate with respect to the rotary shaft.

13. The compressor of claim 12, wherein the fixed head plate further comprises a guide that protrudes from the fixed head plate toward the muffler, that is disposed radially outward of the bypass hole, and that is configured to guide refrigerant to the bypass hole.

14. The compressor of claim 13, wherein the guide is disposed at the second side of the fixed head plate with respect to the rotary shaft.

15. The compressor of claim 1, wherein a distal end of the fixed shaft accommodation portion faces and contacts an inner surface of the muffler.

16. The compressor of claim 1, wherein the rotary shaft defines a plurality of oil holes that radially extend from an inside of the rotary shaft toward an outer circumferential surface of the rotary shaft and that are arranged along the axial direction of the rotary shaft.

17. A compressor comprising:

a case comprising a discharge portion disposed at one side of the case, the discharge portion being configured to discharge refrigerant from the case;

a drive unit coupled to an inner circumferential surface of the case;

a rotary shaft that extends from the drive unit in a direction away from the discharge portion and that is configured to rotate about an axis;

an orbiting scroll coupled to the rotary shaft and configured to rotate based on a rotation of the rotary shaft;

a fixed scroll engaged with the orbiting scroll, the fixed scroll defining a compression space configured to receive, compress, and discharge refrigerant; and a muffler that is coupled to the fixed scroll, and that defines a receiving space configured to guide refrigerant toward the discharge portion, wherein the fixed scroll comprises:

a fixed head plate that is coupled to the inner circumferential surface of the case and that defines the compression space, and a fixed shaft accommodation portion that is configured to accommodate the rotary shaft, wherein the fixed head plate defines:

a discharge hole that extends through the fixed head plate and that is configured to discharge compressed refrigerant toward the receiving space of the muffler, and a bypass hole that extends through the fixed head plate and that is configured to guide refrigerant in the receiving space of the muffler toward the discharge portion, wherein the fixed shaft accommodation portion includes a protruding portion that protrudes from the fixed head plate toward the muffler, wherein the discharge hole is spaced apart from the fixed shaft accommodation portion and extends through the fixed head plate in an axial direction, wherein the discharge hole extends from a first end facing the muffler to a second end facing the discharge portion, and wherein an axial length of the discharge hole from the first end to the second end in the axial direction is less than a distance from the first end of the discharge hole to a distal end of the protruding portion of the fixed shaft accommodation portion facing the muffler.

18. A compressor comprising:

a case comprising a discharge portion disposed at one side of the case, the discharge portion being configured to discharge refrigerant from the case;

a drive unit coupled to an inner circumferential surface of the case;

a rotary shaft that extends from the drive unit in a direction away from the discharge portion and that is configured to rotate about an axis;

an orbiting scroll coupled to the rotary shaft and configured to rotate based on a rotation of the rotary shaft;

a fixed scroll engaged with the orbiting scroll, the fixed scroll defining a compression space configured to receive, compress, and discharge refrigerant; and a muffler that is coupled to the fixed scroll, and that defines a receiving space configured to guide refrigerant toward the discharge portion, wherein the fixed scroll comprises:

a fixed head plate that is coupled to the inner circumferential surface of the case and that defines the compression space, and a fixed shaft accommodation portion that is configured to accommodate the rotary shaft, wherein the fixed head plate defines:

a discharge hole that extends through the fixed head plate and that is configured to discharge compressed refrigerant toward the receiving space of the muffler, and a bypass hole that extends through the fixed head plate and that is configured to guide refrigerant in the receiving space of the muffler toward the discharge portion, wherein the fixed shaft accommodation portion protrudes from the fixed head plate toward the muffler, wherein the discharge hole is spaced apart from the fixed shaft accommodation portion and extends through the fixed head plate in an axial direction, and wherein the fixed head plate comprises a concave portion having a thickness in the axial direction, the thickness of the concave portion decreasing from the fixed shaft accommodation portion to the bypass hole.

19. The compressor of claim 18, wherein the concave portion is recessed toward the discharge portion from an exposed surface of the fixed head plate facing the muffler.

* * * * *